United States Patent [19]

Alcantara Maia

[11] Patent Number: 5,065,373

[45] **Date of Patent: * Nov. 12, 1991**

[54] METHOD AND DEVICE FOR HOLDING AN EYEGLASS WITH SUPERIMPOSED LENSES TO A WRIST WATCH

[76] Inventor: Sergio Alcantara Maia, Alameda Casa Branca, 752-Apt. 31, Sao Paulo, Brazil

[ * ] Notice: The portion of the term of this patent subsequent to Dec. 12, 2006 has been disclaimed.

[21] Appl. No.: 233,278

[22] Filed: Aug. 17, 1988

[30] Foreign Application Priority Data

Mar. 24, 1988 [BR] Brazil ..... 8801461[U]

[51] Int. Cl.[5] ..... G04B 47/00; G04B 37/00

[52] U.S. Cl. ..... 368/10; 368/278; 248/DIG. 2

[58] Field of Search ..... 368/10, 88, 276–278, 368/316–317; 248/114–116, DIG. 2

[56] References Cited

U.S. PATENT DOCUMENTS

| | | | |
|---|---|---|---|
| 963,461 | 7/1910 | Mossman | 368/278 |
| 1,913,150 | 6/1933 | Atwater | 368/10 |
| 2,235,095 | 3/1941 | Barthman | 368/278 |
| 2,853,182 | 9/1958 | Barnett | 368/10 |
| 2,948,106 | 8/1960 | Bloomstein | 368/278 |

*Primary Examiner*—Vit W. Miska

*Attorney, Agent, or Firm*—Michael J. Striker

[57] ABSTRACT

A holding device having a frame accommodating a watch body and a drawer attached to the frame underneath the watch body. The drawer accommodates an eyeglass with superimposed lenses. The eyeglass has a flexible bridge between the lenses to enable the lenses to be superimposed one over the other. A face of the watch body and the lenses can have the same shape.

18 Claims, 9 Drawing Sheets

FIG. 1
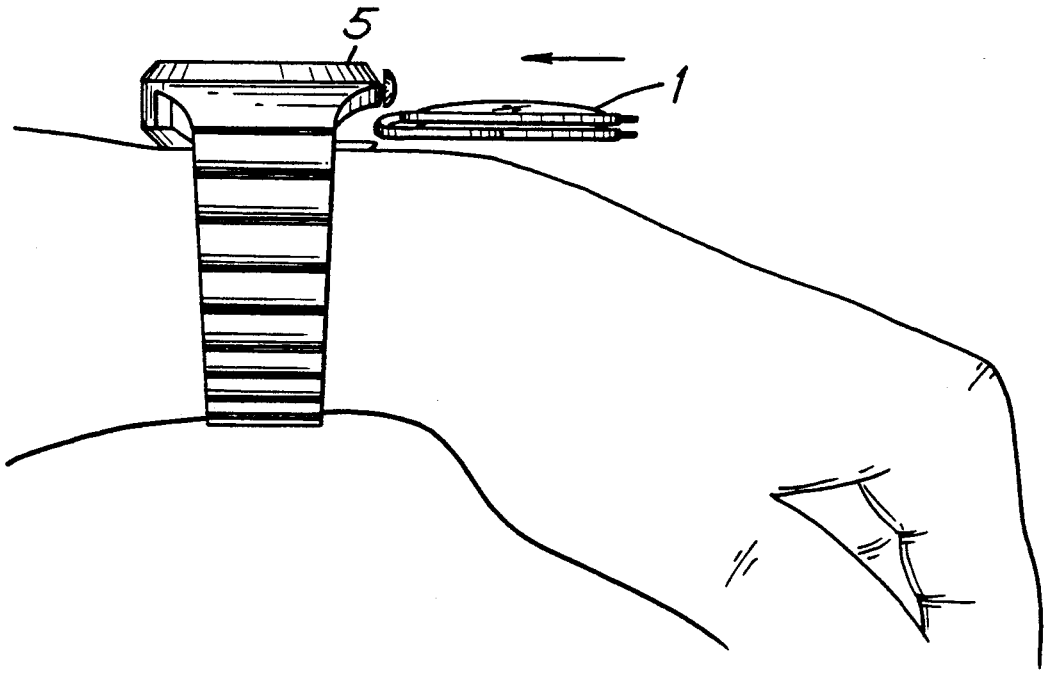
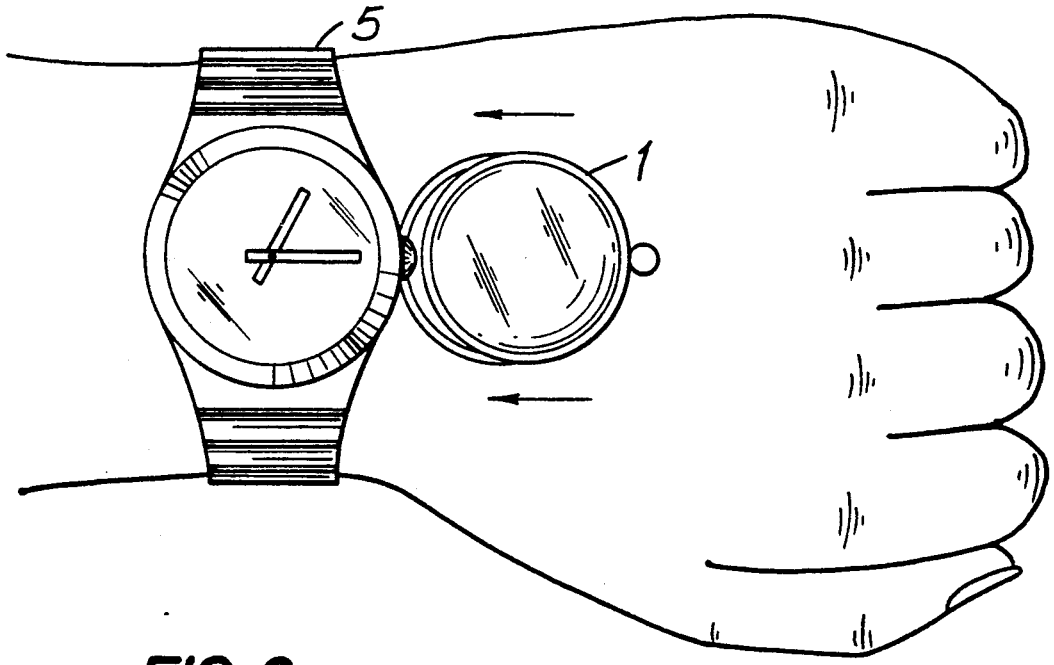
FIG. 2

FIG. 10
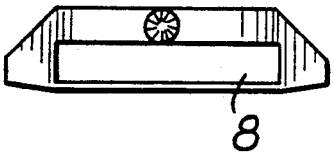
FIG. 11
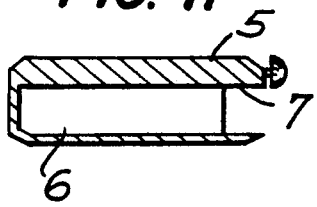
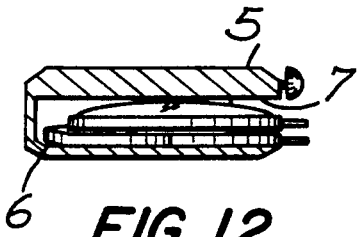
FIG. 12
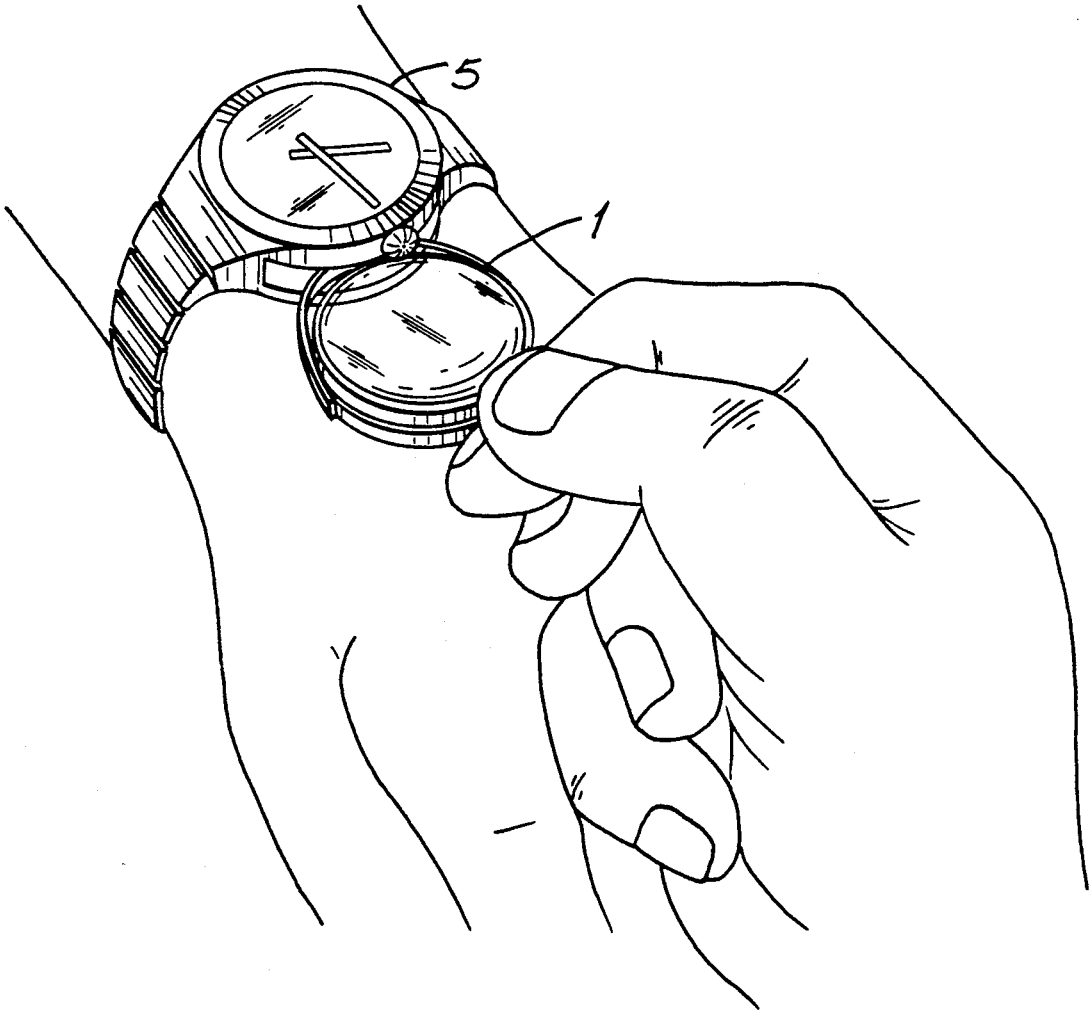
FIG. 13

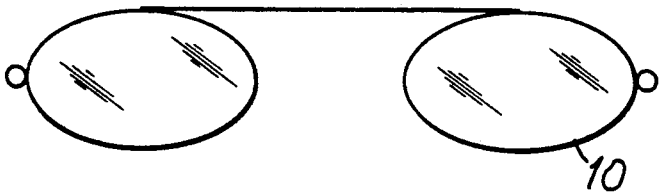
FIG. 14
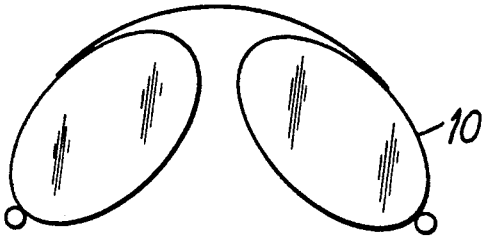
FIG. 15
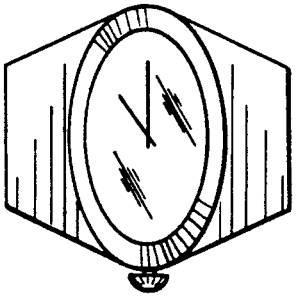
FIG. 18
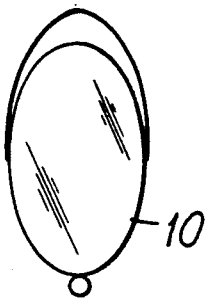
FIG. 16
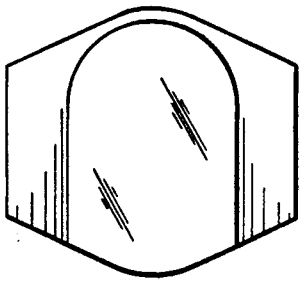
FIG. 19
FIG. 17
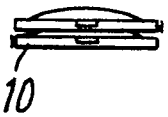
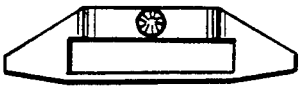
FIG. 20
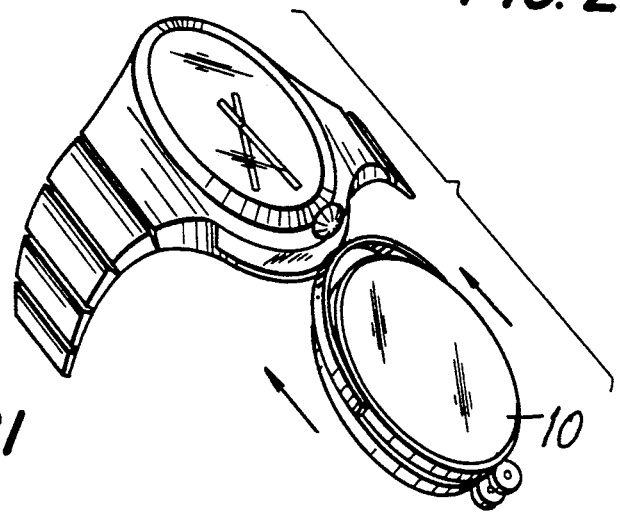
FIG. 21

METHOD AND DEVICE FOR HOLDING AN EYEGLASS WITH SUPERIMPOSED LENSES TO A WRIST WATCH

BACKGROUND OF THE INVENTION

The present invention relates generally to holding or coupling an eyeglass with superimposed lenses to a wristwatch.

A large number of individuals do not use eyeglasses all the time, but must constantly carry their glasses even though their use is intermittent. For example, such individuals may have good eyesight for distance, but require glasses for reading.

SUMMARY OF THE INVENTION

It is the object of the present invention to retain dismountable eyeglasses in a wrist watch so as to avoid the inconvenience of constantly remembering to carry glasses which are used only intermittently.

In keeping with the object, and others which will become apparent hereafter, one aspect of the invention resides, briefly stated, in a holding device having a frame with an area formed to accomodate a watch. The holding device also has a drawer under the area and attached to the frame. The drawer has a bottom and a wall extending from the bottom. The wall has an opening through which an eyeglass with superimposed lenses is insertable. The eyeglass has a bridge extending between and releasably connecting the lenses. The bridge is either flexible or foldable so as to be formed for superimposing the lenses of the eyeglass.

An additional object is to insert the eyeglass into the drawer under the wrist body. Both a face of the wristwatch and the lenses of the eyeglass have the same shape.

Another object is to insert lenses that have either a circular, oval, square, or semi-circular shape. The lenses may be filtered or corrective lenses.

Still another object is to provide a second drawer in the area in which is accomodated a removable watch body.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 1 and 2 are side elevational and top views respectively of a circular eyeglass embodiment being inserted into a drawer of the circular face wristwatch embodiment in accordance with the present invention.

FIG. 3 shows the eyeglass before flexing or folding. FIGS. 4 and 5 are progressive views showing the eyeglass during flexing or folding. FIG. 6 shows the eyeglass fully flexed or folded into a superimposed position. FIG. 7 is a side elevational view as viewed from the bottom of FIG. 6.

FIG. 9 is shown with a transparent face so that the drawer becomes visible.

FIG. 10 is a side elevational view taken from the bottom of the top view of FIG. 8.

FIG. 11 is a cross-section taken across section line 11—11 of FIG. 8.

FIG. 12 is the same cross-section as FIG. 11, but with the eyeglass of FIG. 3 inserted in its drawer.

FIG. 13 is a perspective view of the eyeglass being inserted into the drawer of the wristwatch.

FIGS. 14–21 are the same views respectively of FIGS. 3, 4, 6, 7, 8, 9, 10 and 13 but for an oval eyeglass and oval face wristwatch embodiment instead of the circular embodiment.

FIGS. 28 and 30 together show a side elvational view of the eyeglass lined up with the drawer in the wristwatch for insertion therein.

DETAILED DESCRIPTION OF THE PREFERRED EMBODIMENT

Figure 3:
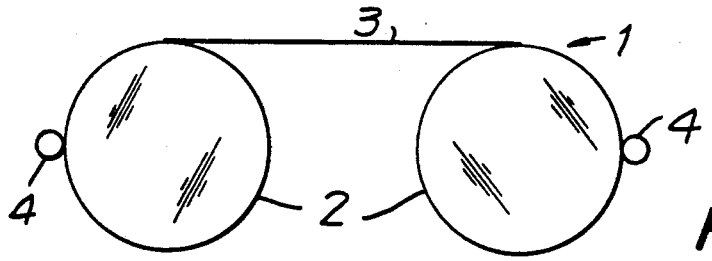
FIGS. 3–7 are progressive front views of the circular eyeglass embodiment having a flexible or foldable rim in accordance with the present invention.
Figure 4:
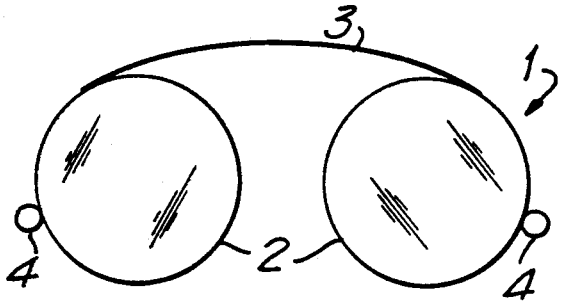
Figure 5:
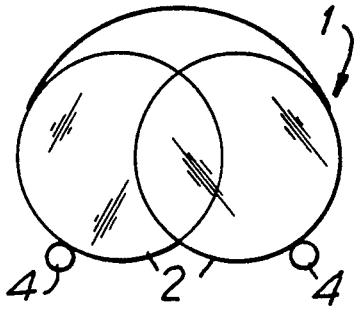
Figure 6:
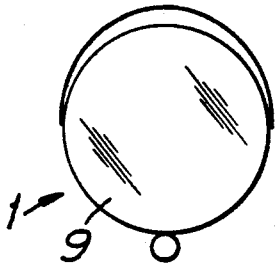
Figure 7:
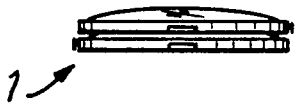
Figure 8:
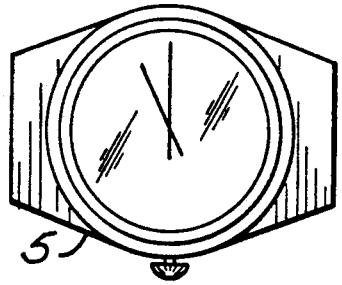
FIGS. 8 and 9 are top views of a wristwatch having a circular face embodiment.
Figure 9:
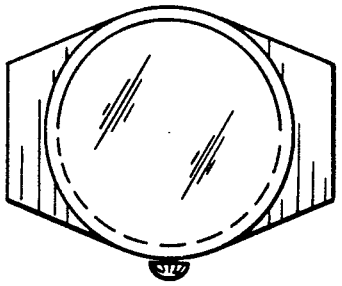
Figure 22:
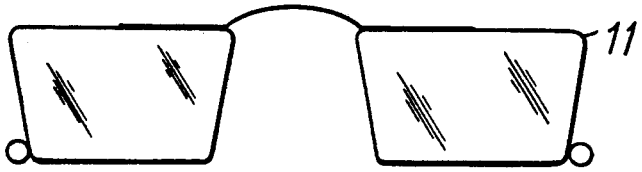
FIGS. 22–29 are the same views respectively of FIGS. 3, 5, 6, 7, 8, 9, 11 and 13 but for a square eyeglass and square face wristwatch embodiment instead of the circular embodiment.
Figure 23:
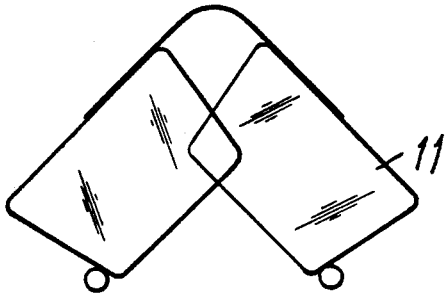
Figure 24:
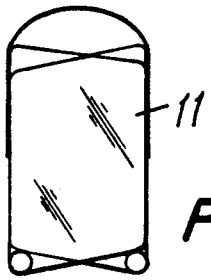
Figure 25:
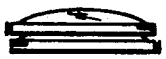
Figure 26:
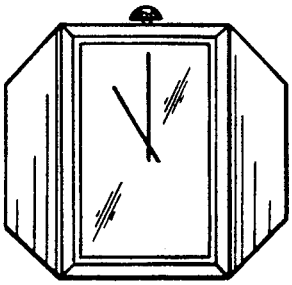
Figure 27:
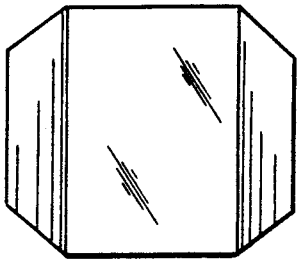
Figure 28:
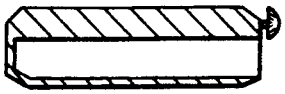
Figure 30:
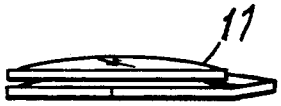
FIG. 30 is a side elevational view taken from the right side of FIG. 24.
Figure 29:
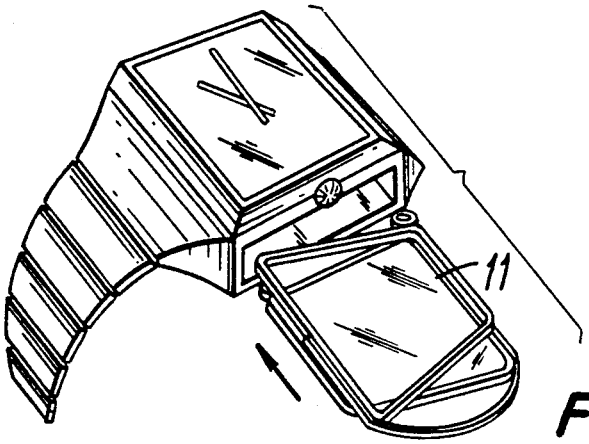
Figure 31:
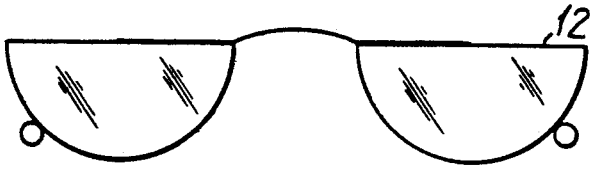
FIGS. 31–39 are the same views respectively of FIGS. 22–30 but for a "granny" model eyeglass embodiment (for reading only) instead of the square eyeglass embodiment.
Figure 32:
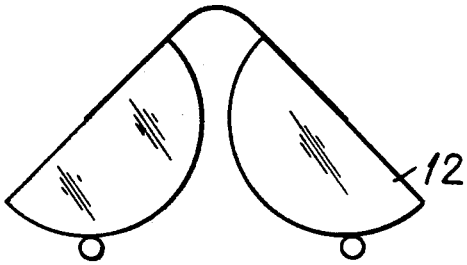
Figure 33:
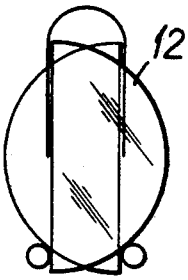
Figure 34:
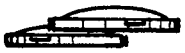
Figure 35:
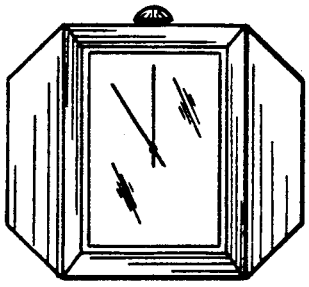
Figure 36:
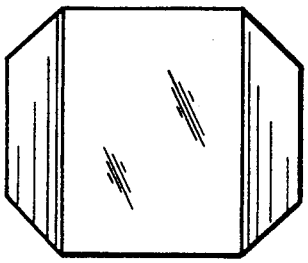
Figure 37:
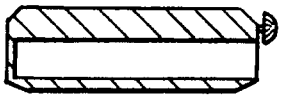
Figure 39:
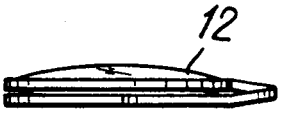
Figure 38:
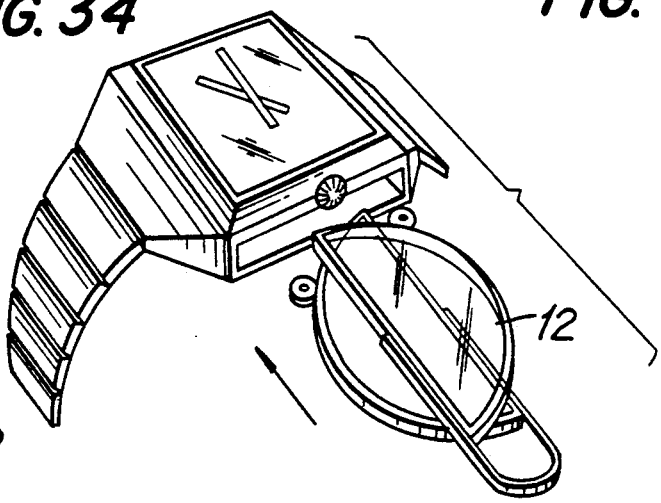

Referring now to the drawings, an eyeglass 1 and a wrist watch 5 are shown. The eyeglass has two lenses 2 and a rim 3 securing the lenses to the rim 3 in a conventional manner. The rim 3 itself is flexible or foldable. Tabs 4 extend outward from the lenses 2 to facilitate grasping of the lenses 2 to avoid smudging the lenses 2 by fingerprints. The lenses 2 can be superimposed over one another by flexing or folding the rim 3 as shown in the drawings. The eyeglass is dismountable.

When the lenses are fully superimposed, the eyeglass 1 can be inserted into a drawer 6 formed underneath the body 7 of the wristwatch 5. The drawer has an opening 8.

The drawer 6 is formed to accomodate the eyeglass 1 therein. The lenses can have a shape which is either circular 9, oval 10, square 11, or semicircular 12. The watch face can have a shape which corresponds to that of the eyeglass (e.g. circular, oval, square). This helps a user to know the shape of the lenses that are contained within the drawer. In the case of a semicircular lense (a "granny" model eyeglass), the wristwatch face can be square as shown. The drawer 6 and body 7 may be formed as one piece.

One half of the drawer can conform in shape to the eyeglass to provide for a snug fit of the eyeglass in the drawer and thereby prevent the eyeglass from rattling or moving around in the drawer. The other half has a constant width extending all the way to the opening 8.

The eyeglass in a superimposed position has two diameters perpendicular to each other. Where one such diameter is smaller than the other, the constant width of the drawer should accomodate the smaller diameter and the drawer should have a length long enough to accomodate the larger diameter.

One way to help retain the eyeglass in the drawer is to form the drawer with an inclined tab by the opening 8. Thus, when fully inserted, the eyeglass rests on the bottom surface of the drawer next to the inclined tab and is thereby prevented from sliding out on its own during normal use. Also, the snugness of the fit of the eyeglass against the one half of the drawer which conforms in shape to the eyeglass promotes retention. Other means can also be used for retaining the eyeglass in the drawer.

The eyeglass can be of any type, including bifocal lens eyeglass which is not shown in the drawing, etc.

Figure 40:
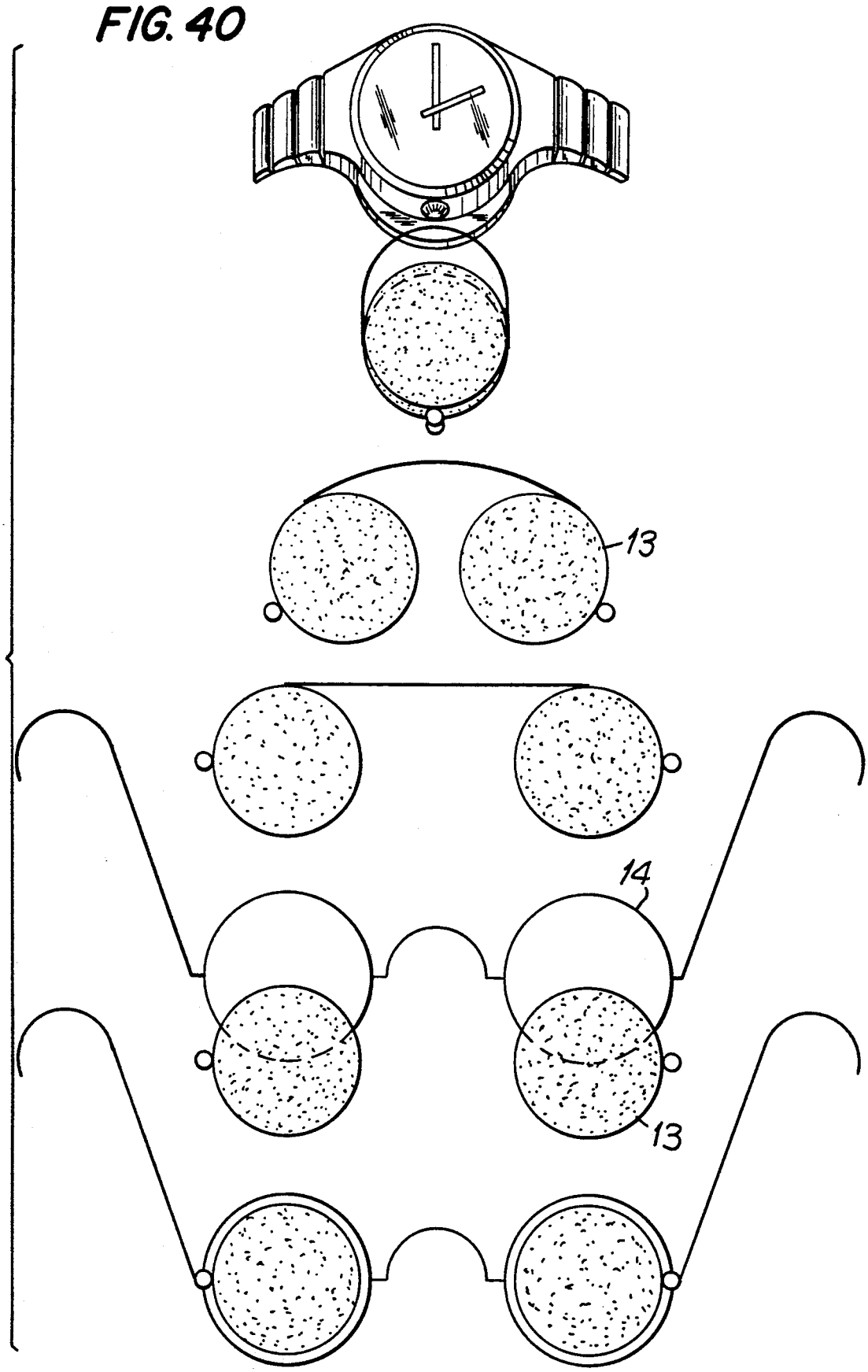
FIG. 40 shows a filter eyeglass embodiment in progressive stages for placement onto conventional spectacles.

The eyeglass may have filter lenses 13 which can be placed on conventional spectacles 14 with gradation and a transparent as shown in FIG. 40.

Figure 41:
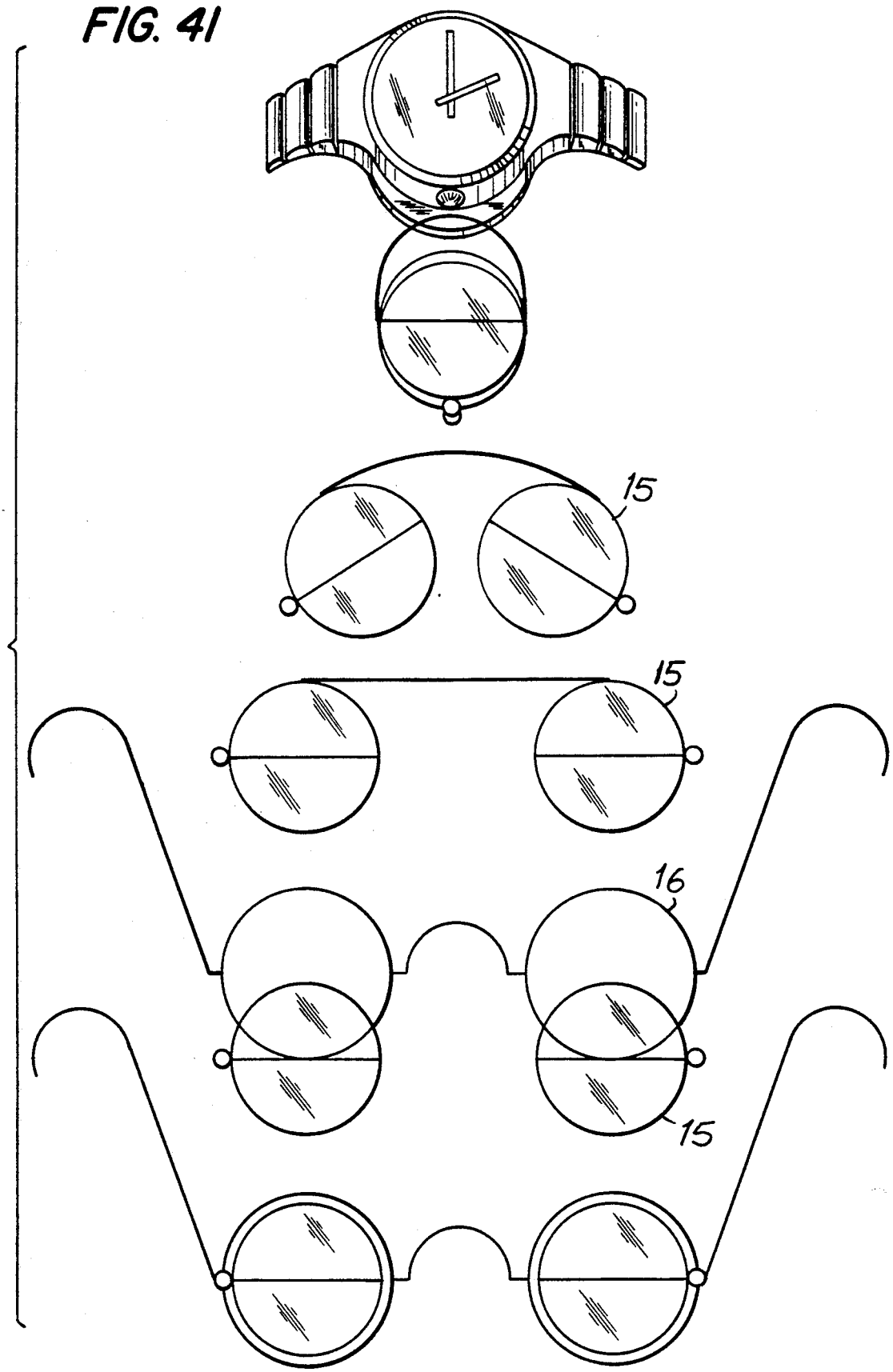
FIG. 41 shows a reading eyeglass embodiment in progressive stages for placement onto conventional spectacles.

The eyeglass may have corrective lenses 15 which compensate the magnification afforded by conventional spectacles 16. For instance, the corrective lenses 15 would enable one to see near objects although the spectacles 16 were formed to be used for distance as shown in FIG. 41.

Figure 42:
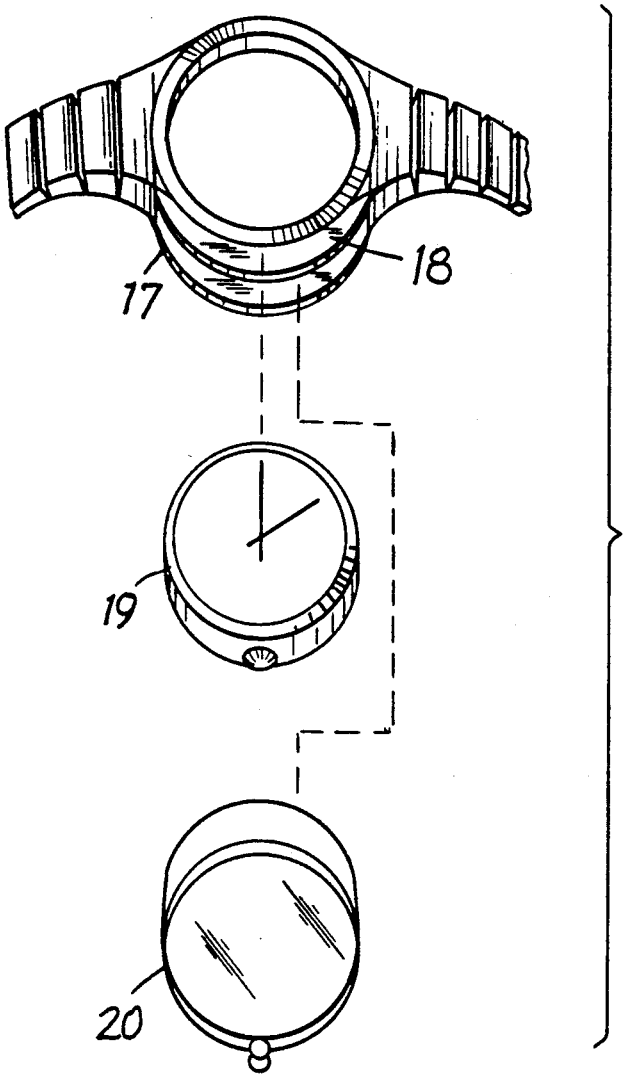
FIG. 42 is an exploded top perspective view of a dual-drawer embodiment showing a watch piece and an eyepiece removed from separate drawers in a watch frame.
Figure 43:
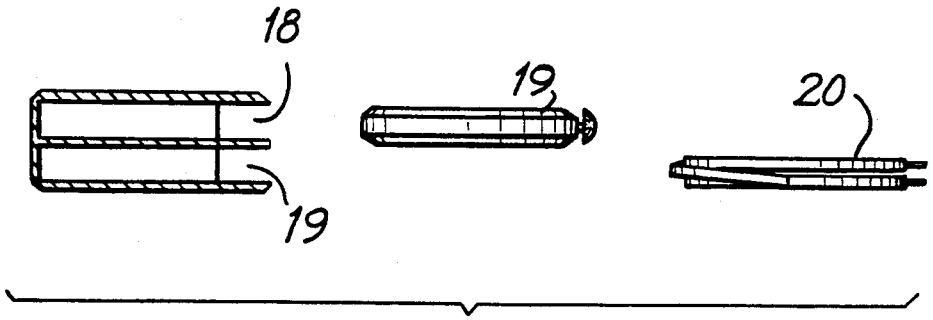
FIG. 43 is a exploded side elevational view of FIG. 42, except without the wristband shown.

As an additional embodiment, the wristwatch may have a frame 17 which is formed with two drawers 18, 19. The top drawer 18 accomodates a watch body 19. The bottom drawer 19 accomodates the eyeglass 20. Such a frame 17 may be substituted by other frames having the same sized drawers 18, 19. Thus, wristbands of different colors and designs may be easily interchanged with each other for use with watch body 19 and eyeglass 20 as shown in FIGS. 42 and 43.

Although one type of wristwatch is shown, other types of watches can be readily used instead, such as pocket watches, feminine design on a necklace or a chain, etc.

It will be understood that each of the elements described above, or two or more together, may also find a useful application in other types of devices and methods of holding an eyeglass with superimposed lenses to a wristwatch differing from the types described above.

While the invention has been illustrated and described as embodied in a device and method of holding an eyeglass with superimposed lenses to a wristwatch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for the various applications without omitting features that, from the standpoint of prior art, fairly constitute essential characteristics of the generic or specific aspects of this invention.

What is claimed as new and desired to be protected by Letters Patent is set forth in the appended claims:

1. A portable device, comprising:

a frame having an area formed to accomodate a watch body; and a drawer formed on said frame underneath said area, said drawer being formed to accomodate an eyeglass with superimposed lenses, said drawer having a bottom and a wall extending from said bottom, said wall having an opening through which said eyeglass is removably insertable.

2. The device as defined in claim 1; and further comprising:

an eyeglass with two lenses and a bridge extending between and releaseably connected to said two lenses, said bridge being formed so that said lenses can be superimposed one over the other.

3. The device as defined in claim 2, wherein said bridge is flexible to allow said lenses to become superimposed.

4. The device as defined in claim 2, wherein said bridge is foldable to allow said lenses to become superimposed.

5. The device as defined claim 2; and further comprising:

a second drawer in said area, said area having a wall with an opening through which said watch body is removably inserted into said second drawer.

6. The device as defined in claim 2; and further comprising:

means for retaining said eyeglass in said drawer.

7. The device as defined in claim 6, said retaining means including an inclined tab extending from said bottom into said opening.

8. The device as defined in claim 6, said retaining means includes a portion of said drawer conforming in shape to said eyeglass, said portion being spaced away from said opening.

9. The device as defined in 2; and further comprising:

a watch body accomodated in said area.

10. The device as defined in claim 9, wherein said lenses have an essentially identical shape, said watch body having a face conforming in shape to that of said lenses.

11. The device as defined in claim 2, wherein said lenses are selected from the group consisting of circular lenses, oval lenses, square lenses, semicircular lenses, filter lenses and corrective lenses.

12. A method of holding, comprising the steps of:

forming a drawer underneath an area of a frame formed to accomodate a watch body, said drawer having a bottom and a wall extending from said bottom, said wall having an opening; and inserting an eyeglass that has superimposed lenses into said drawer through said opening.

13. The method as defined in claim 12; and further comprising:

superimposing the lenses of the eyeglass.

14. The method as defined in claim 13, wherein said superimposing includes flexing a bridge extending between and releasably connecting the lenses.

15. The method as defined in claim 13, wherein said superimposing includes folding a bridge extending between and releasably connecting the lenses.

16. The method as defined in claim 12; and further comprising:

accomodating a watch body in the area, the watch body having a face with a shape matching a shape of the lenses.

17. The method as defined in claim 12; and further comprising:

inserting a watch body through an opening in a wall of a second drawer in the area, the second drawer being attached to the frame.

18. The method as defined in claim 13, wherein the superimposing includes selecting lenses from the group consisting of circular lenses, oval lenses, square lenses, semi-circular lenses, filter lenses and corrective lenses.

* * * * *